US007343901B2

(12) United States Patent
Mori et al.

(10) Patent No.: US 7,343,901 B2
(45) Date of Patent: Mar. 18, 2008

(54) FUEL SUPPLY DEVICE

(75) Inventors: Katsumi Mori, Chiryu (JP); Akihiro Kuroda, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 110 days.

(21) Appl. No.: 11/329,106

(22) Filed: Jan. 11, 2006

(65) Prior Publication Data

US 2006/0169251 A1 Aug. 3, 2006

(30) Foreign Application Priority Data

Jan. 28, 2005 (JP) ..... 2005-021770

(51) Int. Cl.
*F02M 33/02* (2006.01)
*F02M 63/00* (2006.01)

(52) U.S. Cl. ..... 123/446; 123/457; 123/458; 123/511

(58) Field of Classification Search ..... 123/446, 123/447, 510–511, 457–458
See application file for complete search history.

(56) References Cited

U.S. PATENT DOCUMENTS

| | | | | |
|---|---|---|---|---|
| 4,423,751 | A * | 1/1984 | Roettgen | 137/557 |
| 4,740,140 | A * | 4/1988 | Benson | 417/63 |
| 4,884,545 | A * | 12/1989 | Mathis | 123/447 |
| 6,058,912 | A * | 5/2000 | Rembold et al. | 123/516 |
| 6,142,120 | A * | 11/2000 | Biester et al. | 123/456 |
| 6,234,148 | B1 * | 5/2001 | Hartke et al. | 123/447 |
| 6,253,734 | B1 * | 7/2001 | Rembold et al. | 123/446 |
| 6,609,500 | B2 * | 8/2003 | Ricco et al. | 123/446 |
| 6,848,423 | B2 * | 2/2005 | Schmidl et al. | 123/446 |
| 7,128,054 | B2 * | 10/2006 | Koehler et al. | 123/446 |
| 7,156,076 | B2 * | 1/2007 | Holl et al. | 123/446 |
| 2004/0208753 | A1 | 10/2004 | Mori | |
| 2005/0241616 | A1 | 11/2005 | Holl et al. | |
| 2006/0016432 | A1 | 1/2006 | Koehler et al. | |

FOREIGN PATENT DOCUMENTS

| | | | |
|---|---|---|---|
| CN | 1538053 | A | 10/2004 |
| DE | 102 39 429 | A1 | 3/2004 |
| DE | 102 44 551 | A1 | 4/2004 |
| JP | 2002364479 | | 12/2002 |

OTHER PUBLICATIONS

Chinese Office Action mailed Aug. 17, 2007 in Chinese Application No. 200610006928.6 with English translation.

* cited by examiner

*Primary Examiner*—Thomas Moulis
(74) *Attorney, Agent, or Firm*—Nixon & Vanderhye P.C.

(57) ABSTRACT

A fuel filter is located downstream of a feed pump to filter fuel discharged from the feed pump. An orifice is located between the fuel filter and a suction quantity control valve to restrict a flow rate of the fuel passing through the fuel filter. A positive pressure of the feed pump is applied to the fuel filter, and a passing pressure at the fuel filter increases. Even if viscosity of the fuel increases and the fuel becomes wax-like at low temperature, clogging of the fuel filter or an insufficient flow rate can be inhibited. The orifice restricts the flow rate of the fuel passing through the fuel filter. Accordingly, an increase in size of the fuel filter can be prevented even if the fuel filter is located downstream of the feed pump.

11 Claims, 7 Drawing Sheets

FUEL SUPPLY DEVICE

CROSS REFERENCE TO RELATED APPLICATION

This application is based on and incorporates herein by reference Japanese Patent Application No. 2005-21770 filed on Jan. 28, 2005.

BACKGROUND OF THE INVENTION

1. Field of the Invention

The present invention relates to a fuel supply device used in a pressure accumulation fuel injection system of an internal combustion engine. Specifically, the present invention relates to a fuel filter that filters fuel drawn by a feed pump.

2. Description of Related Art

A pressure accumulation fuel injection system is known as a fuel injection system of a diesel engine and the like. As shown in FIG. 7, this system has a common rail 100, a fuel supply pump 110, an injector 120 and the like. The common rail 100 accumulates high-pressure fuel. The fuel supply pump 110 pressure-feeds the fuel to the common rail 100. The injector 120 injects the high-pressure fuel supplied from the common rail 100 into a cylinder of the diesel engine.

The fuel supply pump 110 of this system has a feed pump 140 that draws the fuel from a fuel tank 130. A fuel filter 150 is located upstream of the feed pump 140. The fuel drawn by the feed pump 140 passes through the fuel filter 150 and is filtered (for example, as described in JP-A-2004-316518).

In the case where the fuel filter 150 is located upstream of (on a suction side of) the feed pump 140, a fuel pressure (passing pressure) applied to the fuel filter 150 is low. Therefore, for example, if viscosity of the fuel increases and the fuel becomes wax-like when temperature is low, the fuel filter 150 will be clogged, and a flow rate will become insufficient immediately. As a result, there is a possibility that the fuel discharged from the fuel supply pump 110 becomes insufficient. In such a case, engine stall can be caused.

As shown in FIG. 8, another fuel injection system has a fuel filter 150 downstream of the feed pump 140. In the fuel injection system shown in FIG. 8, an entire quantity of the fuel drawn by the feed pump 140 passes through the fuel filter 150. Accordingly, the body size of the fuel filter 150 increases. In such a case, it is difficult to install the fuel filter 150 to a diesel engine having a tight space (for example, a diesel engine with a small engine displacement).

SUMMARY OF THE INVENTION

It is therefore an object of the present invention to locate a fuel filter downstream of a feed pump and to reduce the size of the fuel filter.

According to an aspect of the present invention, a fuel supply device of a pressure accumulation fuel injection system has a high-pressure pump, a feed pump, a suction quantity control valve, a fuel filter, and a flow rate restricting device. The high-pressure pump pressurizes the fuel and pressure-feeds the fuel to the common rail. The feed pump is driven by the engine to draw the fuel from a fuel tank and to supply the fuel to the high-pressure pump. The suction quantity control valve is located downstream of the feed pump to control a quantity of the fuel supplied from the feed pump to the high-pressure pump. The fuel filter is located between the feed pump and the suction control valve to filter the fuel discharged by the feed pump. The flow rate restricting device is located upstream of the suction quantity control valve to restrict a flow rate of the fuel passing through the fuel filter.

Since the fuel filter is located downstream of the feed pump, a positive pressure of the feed pump is applied to the fuel filter. Accordingly, a passing pressure of the fuel filter increases compared to the case where the fuel filter is located upstream of the feed pump. Thus, even in the case where viscosity of the fuel increases and the fuel becomes wax-like at low temperature, clogging of the fuel filter or an insufficient flow rate can be inhibited. Since the flow rate restricting device is located upstream of the suction quantity control valve, a flow rate of the fuel passing through the fuel filter can be restricted. Therefore, an increase in the size of the fuel filter is inhibited even if the fuel filter is located downstream of the feed pump. As a result, a space for installing the fuel filter can be reduced.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
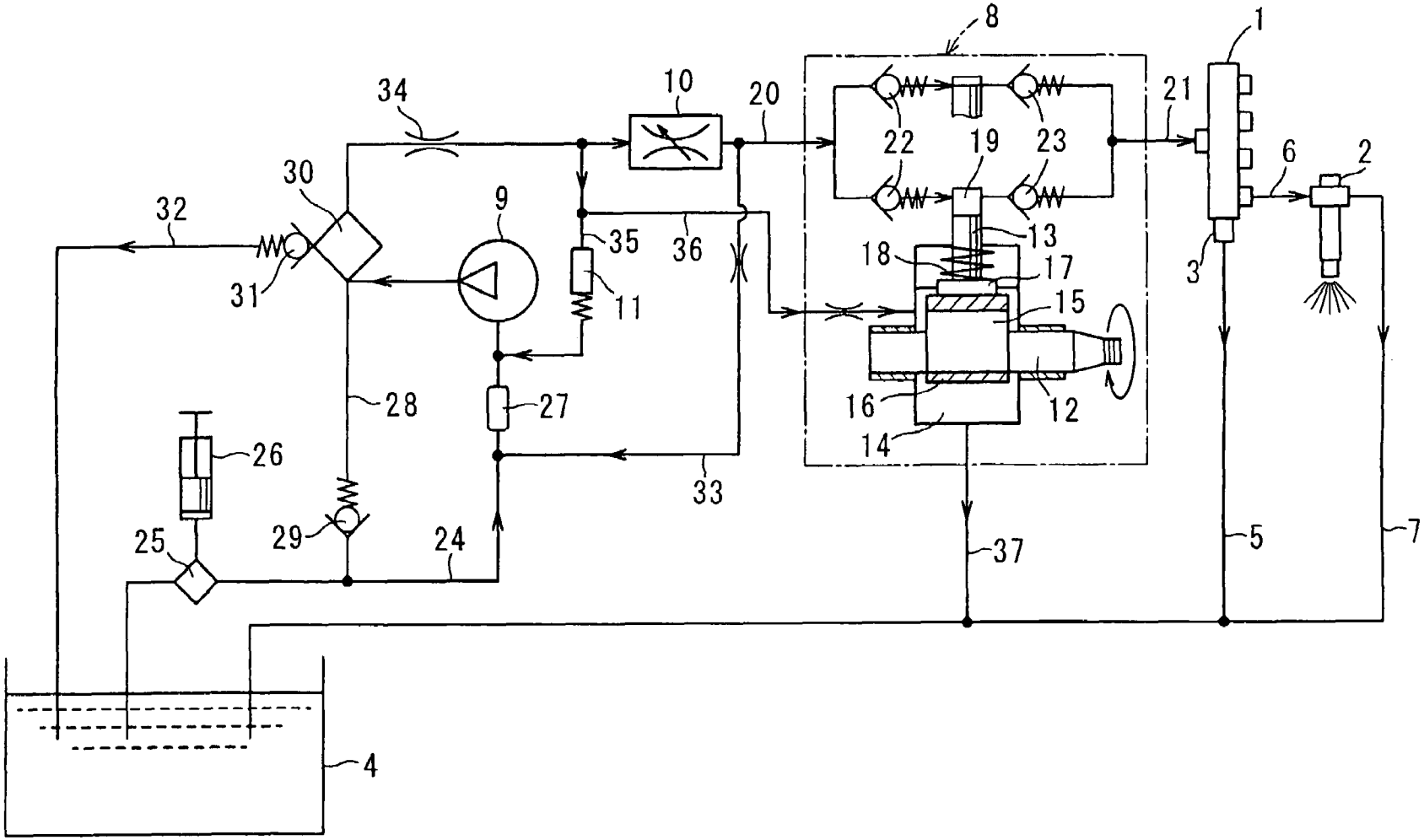
FIG. 1 is a schematic diagram showing a pressure accumulation fuel injection system according to a first embodiment of the present invention.

Referring to FIG. 1, a pressure accumulation fuel injection system according to a first embodiment of the present invention is illustrated. The fuel injection system according to the first embodiment is used in a four-cylinder diesel engine (not shown), for example. As shown in FIG. 1, the fuel injection system includes a common rail 1, at least one injector 2, a fuel supply device and the like. The common rail 1 accumulates high-pressure fuel. The injector 2 injects the high-pressure fuel supplied from the common rail 1 into a cylinder of the diesel engine. The fuel supply device supplies the high-pressure fuel to the common rail 1. An electronic control unit (ECU, not shown) controls operation of the fuel supply device and the injector 2.

The common rail 1 accumulates the high-pressure fuel supplied from the fuel supply device to a target rail pressure.

The ECU sets the target rail pressure based on operating states of the diesel engine (for example, an accelerator position and engine rotation speed). The common rail 1 is equipped with a pressure limiter 3 that opens to release the fuel pressure from the common rail 1 if the accumulated fuel pressure exceeds a predetermined upper limit value. The pressure limiter 3 is connected with a fuel pipe 5 communicating with a fuel tank 4. If the pressure limiter 3 opens, the fuel accumulated in the common rail 1 is returned to the fuel tank 4 through the fuel pipe 5.

The injector 2 is mounted to each cylinder of the diesel engine and is connected with the common rail 1 through a high-pressure pipe 6. The ECU electronically controls fuel injection timing and fuel injection quantity of the injector 2. The injector 2 is connected with a fuel pipe 7 communicating with the fuel tank 4. Out of the fuel supplied from the common rail 1, surplus fuel that is not injected is returned to the fuel tank 4 through the fuel pipe 7.

The fuel supply device includes a high-pressure pump 8, a feed pump 9, a suction quantity control valve 10, a regulation valve 11, and the like. The high-pressure pump 8 pressurizes the fuel and pressure-feeds the fuel to the common rail 1. The feed pump 9 supplies the fuel to the high-pressure pump 8. The suction quantity control valve 10 controls the fuel quantity supplied from the feed pump 9 to the high-pressure pump 8. The regulation valve 11 regulates a discharge pressure of the feed pump 9.

The high-pressure pump 8 has a camshaft 12 driven and rotated by the diesel engine and two plungers 13 driven by the camshaft 12 to reciprocate in cylinders. The high-pressure pump 8 suctions or discharges the fuel in accordance with the reciprocation of the plungers 13. The two plungers 13 are located opposite to each other along a radial direction of the camshaft 12 to perform suction and discharge of the fuel in turn.

The camshaft 12 is equipped with a cam device that converts rotational movement of the camshaft 12 into linear movement and transmits the movement to the plunger 13. The cam device is located in a cam chamber 14 formed in a pump housing (not shown). The cam device is provided by an eccentric cam 15 and a cam ring 16. The eccentric cam 15 rotates eccentrically with respect to a rotational axis of the camshaft 12. The cam ring 16 is fit to an outer periphery of the eccentric cam 15 through a metal bush (not shown) so that relative rotation can be performed between the cam ring 16 and the eccentric cam 15.

A tappet 17 is integrated to an end of the plunger 13 on the camshaft 12 side. The tappet 17 is biased by a spring 18 and is pressed against an outer peripheral surface of the cam ring 16. If the camshaft 12 rotates, the eccentric rotation of the eccentric cam 15 is converted into the linear movement through the cam ring 16, and the linear movement is transmitted to the tappet 17. Thus, the plunger 13 reciprocates in the cylinder.

A pressurizing chamber 19 is formed in the cylinder. A volume of the pressurizing chamber 19 changes in accordance with the reciprocation of the plunger 13. The pressurizing chamber 19 is connected with a suction passage 20 and a discharge passage 21.

Suction valves 22 are located in the suction passage 20. The suction valves 22 open when the fuel is suctioned into the pressurizing chamber 19. Discharge valves 23 are located in the discharge passage 21. The discharge valves 23 open when the fuel is discharged from the pressurizing chamber 19.

In the high-pressure pump 8, if the plunger 13 moves toward the camshaft 12 in the cylinder, the volume of the pressurizing chamber 19 increases and the pressure inside the pressurizing chamber 19 decreases. Accordingly, the fuel supplied from the freed pump 9 through the suction passage 20 opens the suction valves 22 and is suctioned into the pressurizing chamber 19. If the plunger 13 moves in the direction opposite to the camshaft 12 in the cylinder, the volume of the pressurizing chamber 19 decreases and the fuel suctioned into the pressurizing chamber 19 is pressurized. If the fuel pressure exceeds a valve-opening pressure of the discharge valves 23, the fuel in the pressurizing chamber 19 opens the discharge valves 23 and is discharged to the common rail 1 through the discharge passage 21.

The feed pump 9 is a trochoid pump, for example. If the feed pump 9 is driven by the camshaft 12, the feed pump 9 draws the fuel from the fuel tank 4 through a fuel pipe 24 and supplies the fuel to the high-pressure pump 8. The fuel pipe 24 is equipped with a pre-filter 25 for filtering the fuel and a priming pump 26 for bleeding the air from pipes during vehicle assembly and the like. A gauze filter 27 for eliminating extraneous matters mixed in the fuel in pipes downstream of the pre-filter 25 is located on an inlet side of the feed pump 9 to which the fuel pipe 24 is connected.

The fuel pipe 24 downstream of the pre-filter 25 is connected with a bypass passage 28 for leading the fuel drawn by the priming pump 26 to a downstream side of the feed pump 9. The bypass passage 28 is equipped with a check valve 29 for preventing a backflow of the fuel.

A fuel filter 30 and a relief valve 31 are located on an outlet side (discharge side) of the feed pump 9. The fuel filter 30 filters the fuel discharged by the feed pump 9. The relief valve 31 opens if the fuel pressure applied to the fuel filter 30 exceeds a predetermined value (pressure-resistance upper limit value of the fuel filter 30). If the relief valve 31 opens, a part of the fuel discharged by the feed pump 9 is returned to the fuel tank 4 through a fuel pipe 32 connected with the relief valve 31. Thus, excessive fuel pressure can be prevented from acting on the fuel filter 30. The valve-opening pressure of the relief valve 31 is set lower than the discharge pressure of the feed pump 9 generated during idling operation of the diesel engine. Alternatively, the valve-opening pressure of the relief valve 31 may be set so that the relief valve 31 opens in a higher rotation speed area than idling rotation speed of the diesel engine.

The pre-filter 25 and the gauze filter 27 are relatively coarse-meshed filters made of metal meshes, for example. The fuel filter 30 has a superior filtering performance than the pre-filter 25 or the gauze filter 27 and can eliminate small extraneous matters or water that cannot be eliminated by the pre-filter 25 or the gauze filter 27.

The suction quantity control valve 10 is an electromagnetic valve, a valve opening degree of which is controlled by the ECU based on the operating state of the engine. The suction quantity control valve 10 is located downstream of the fuel filter 30. The downstream side of the suction quantity control valve 10 is connected with a fuel passage 33 for returning the fuel, which leaks when the suction quantity control valve 10 is closed, to the inlet side of the feed pump 9 (upstream side of the gauze filter 27).

A flow rate restricting device is located between the fuel filter 30 and the suction quantity control valve 10 for restricting the flow rate (passing flow rate) of the fuel passing through the fuel filter 30. The flow rate restricting device is an orifice 34 for restricting a passage diameter of the suction passage 20, for example.

The regulation valve 11 is located in a fuel passage 35 connecting the inlet side with the outlet side of the feed pump 9. The regulation valve 11 includes a piston (not shown) that moves in accordance with the fuel pressure discharged by the feed pump 9. The piston opens if the discharge pressure of the feed pump 9 exceeds a predetermined pressure to prevent the discharge pressure of the feed pump 9 from exceeding the predetermined pressure.

The upstream end of the fuel passage 35 is connected with the suction passage 20 that connects the orifice 34 with the suction quantity control valve 10. The downstream end of the fuel passage 35 is connected with the downstream side of the gauze filter 27.

The fuel passage 35 is connected with a fuel passage 36 communicating with the cam chamber 14 from the upstream side of the regulation valve 11. A part of the fuel discharged from the feed pump 9 is supplied as lubrication oil to the cam chamber 14 through the fuel passage 36. The fuel overflowing from the cam chamber 14 is returned to the fuel tank 4 through a fuel passage 37.

The pressure accumulation fuel injection system according to this embodiment has the fuel filter 30 downstream of the feed pump 9. Therefore, a positive pressure of the feed pump 9 is applied to the fuel filter 30. Accordingly, a passing pressure (fuel pressure) applied to the fuel filter 30 is higher than in the case where the fuel filter 30 is located upstream of the feed pump 9. Thus, even if viscosity of the fuel increases and the fuel becomes wax-like at low temperature, clogging of the fuel filter 30 can be inhibited. Accordingly, sufficient fuel can be supplied to the high-pressure pump 8. As a result, problems such as engine stall ascribable to an insufficient fuel flow rate can be inhibited.

The orifice 34 is located between the fuel filter 30 and the suction quantity control valve 10. Therefore, the fuel flow rate passing through the fuel filter 30 is restricted. Accordingly, even if the fuel filter 30 is located downstream of the feed pump 9, an increase in the size of the fuel filter 30 can be inhibited. Thus, an installation space of the fuel filter 30 can be reduced.

The positive pressure of the feed pump 9 acts on the fuel filter 30. Therefore, the clogging of the fuel filter 30 can be inhibited, and the fuel filter 30 having high filtration performance can be used. Thus, the filtering rate of the extraneous matters by the fuel filter 30 can be improved. As a result, reliability of the pressure accumulation fuel injection system can be improved and a lifetime of the system can be extended.

Figure 2:
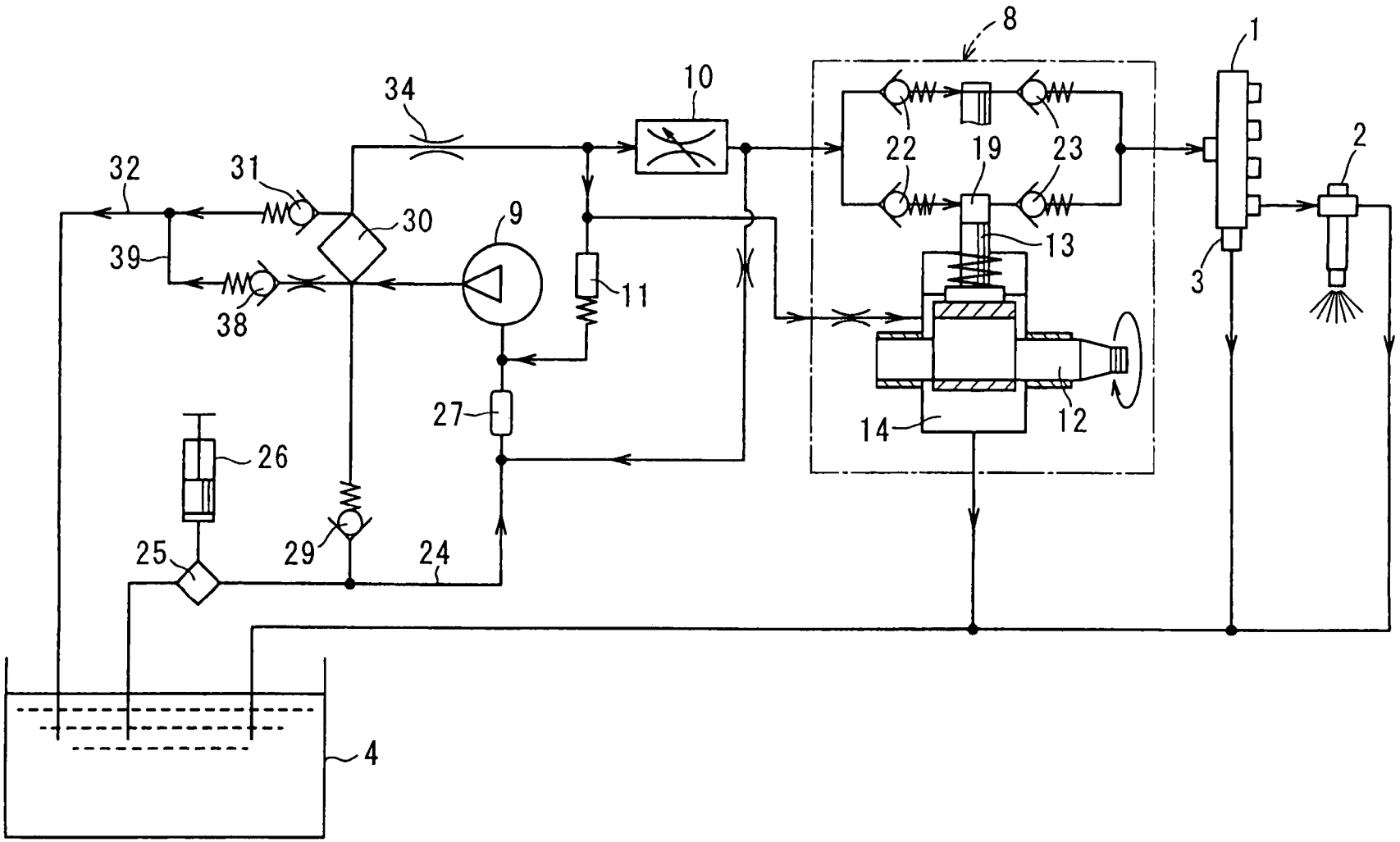
FIG. 2 is a schematic diagram showing a pressure accumulation fuel injection system according to a second embodiment of the present invention.

Referring to FIG. 2, a pressure accumulation fuel injection system according to a second embodiment of the present invention is illustrated. The fuel injection system shown in FIG. 2 has an air-bleeding valve 38 in addition to the relief valve 31.

The relief valve 31 opens if the fuel pressure acting on the fuel filter 30 exceeds the pressure-resistance upper limit value of the fuel filter 30.

The air-bleeding valve 38 is located in an air-bleeding passage 39 connected with a portion of the fuel pipe system where the air tends to collect. The air-bleeding valve 38 receives the discharge pressure of the feed pump 9 and opens. The air-bleeding passage 39 communicates with the fuel tank 4 through the fuel pipe 32, for example. Thus, regardless of the operation of the relief valve 31, the air-bleeding can be performed in accordance with the operation of the feed pump 9.

Figure 3:
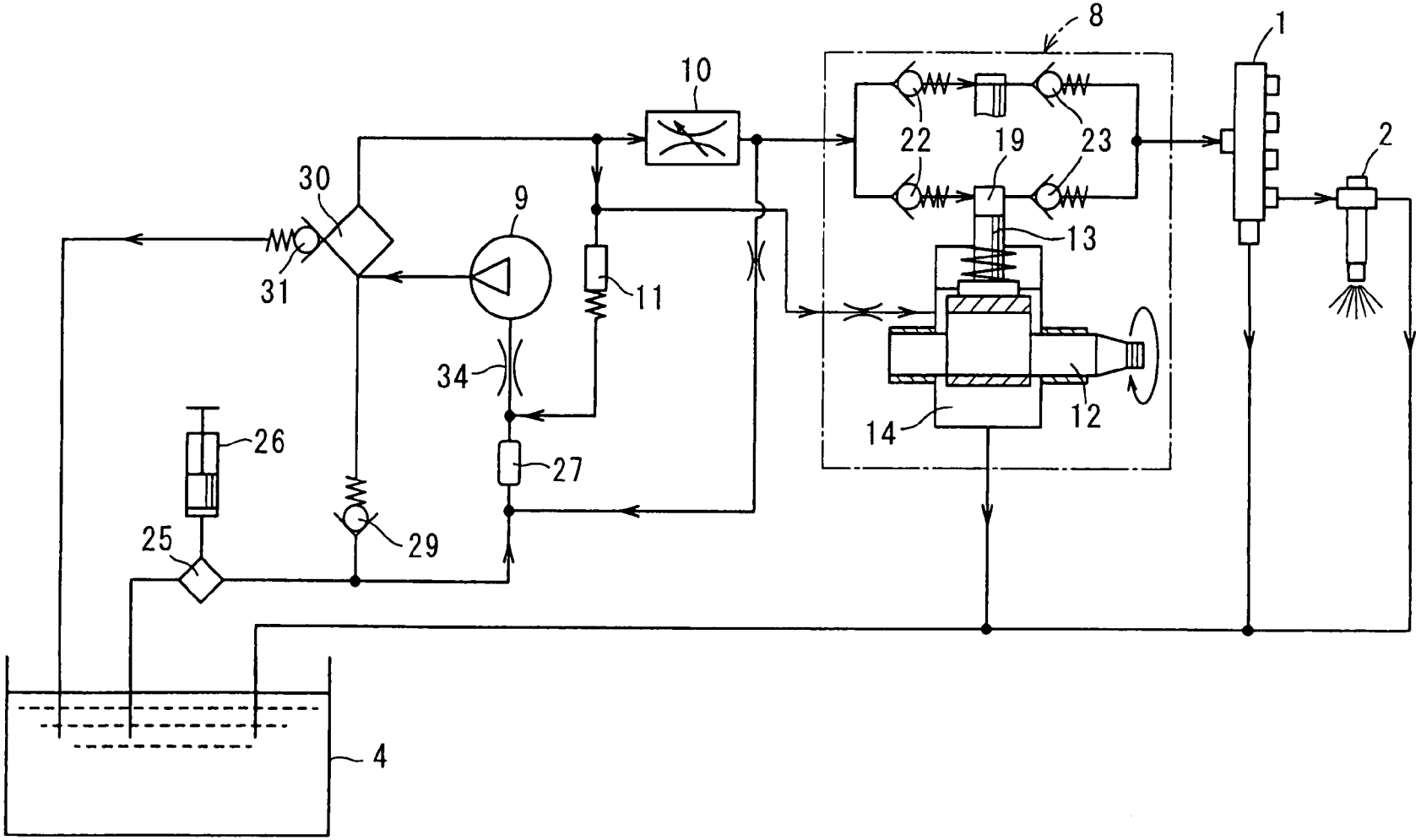
FIG. 3 is a schematic diagram showing a pressure accumulation fuel injection system according to a third embodiment of the present invention.

Referring to FIG. 3, a pressure accumulation fuel injection system according to a third embodiment of the present invention is illustrated. In the fuel injection system of this embodiment, an orifice 34 as a flow rate restricting device is located upstream of (on suction side of) the feed pump 9 as shown in FIG. 3. The orifice 34 is located between the feed pump 9 and the gauze filter 27 upstream of the feed pump 9 as shown in FIG. 3.

Thus, the orifice 34 restricts the suction quantity of the feed pump 9, and a time number the relief valve 31 operates is reduced. Accordingly, a fuel pressure seldom exceeds the pressure-resistance upper limit value of the fuel filter 30, and the time number the relief valve 31 opens decreases. Thus, durability of the relief valve 31 is improved.

Figure 4:
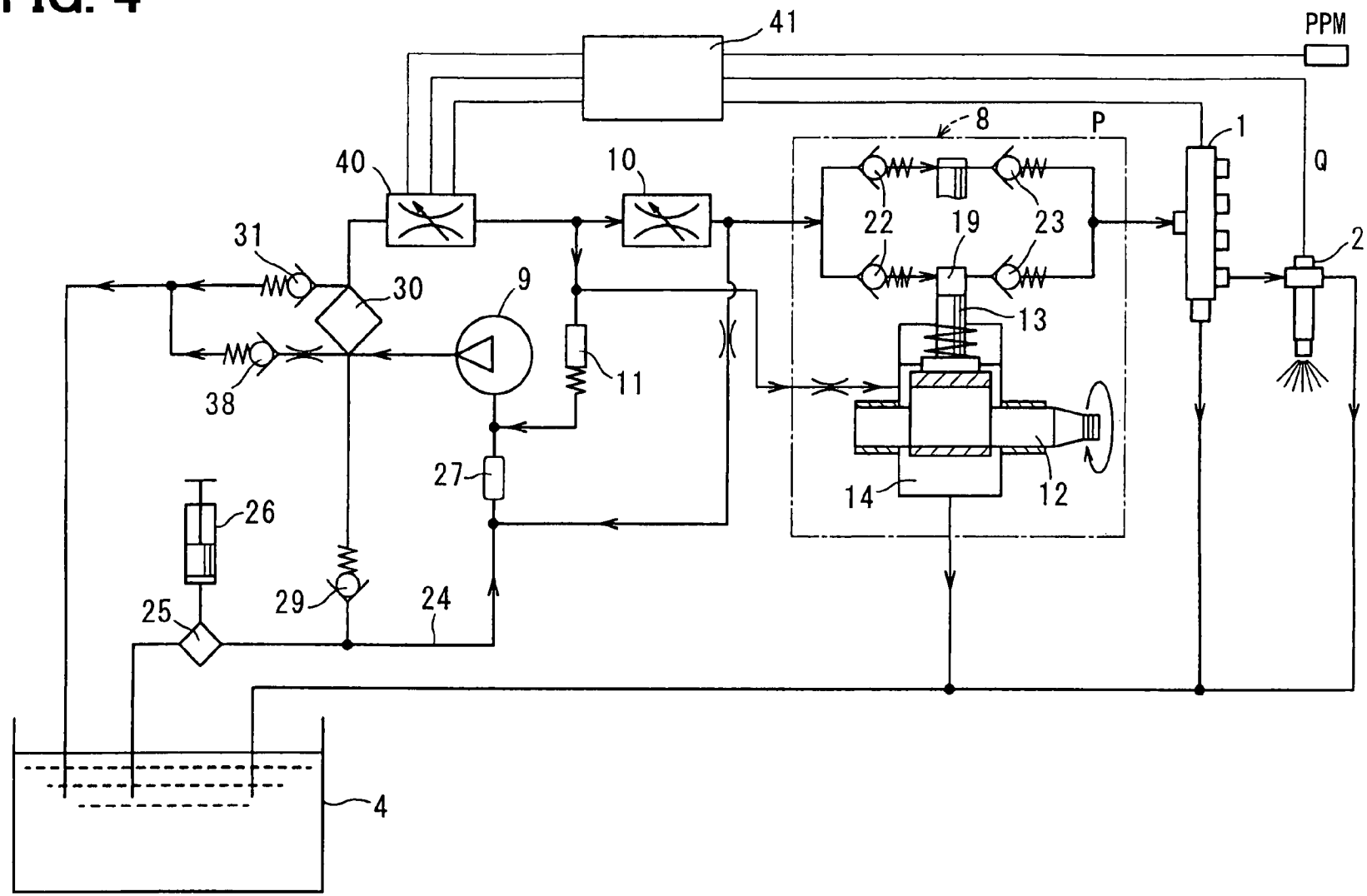
FIG. 4 is a schematic diagram showing a pressure accumulation fuel injection system according to a fourth embodiment of the present invention.

Referring to FIG. 4, a pressure accumulation fuel injection system according to a fourth embodiment of the present invention is illustrated. In the fuel injection system of this embodiment, an electromagnetic valve 40 functions as a flow rate restricting device. An ECU 41 controls the electromagnetic valve 40 based on information about rotation speed (RPM) of the diesel engine, the injection quantity (Q) of the injector 2 and the fuel pressure (P) of the common rail 1, for example. Thus, the flow rate of the fuel passing through the fuel filter 30 can be controlled finely in accordance with the operating state of the engine.

Figure 5:
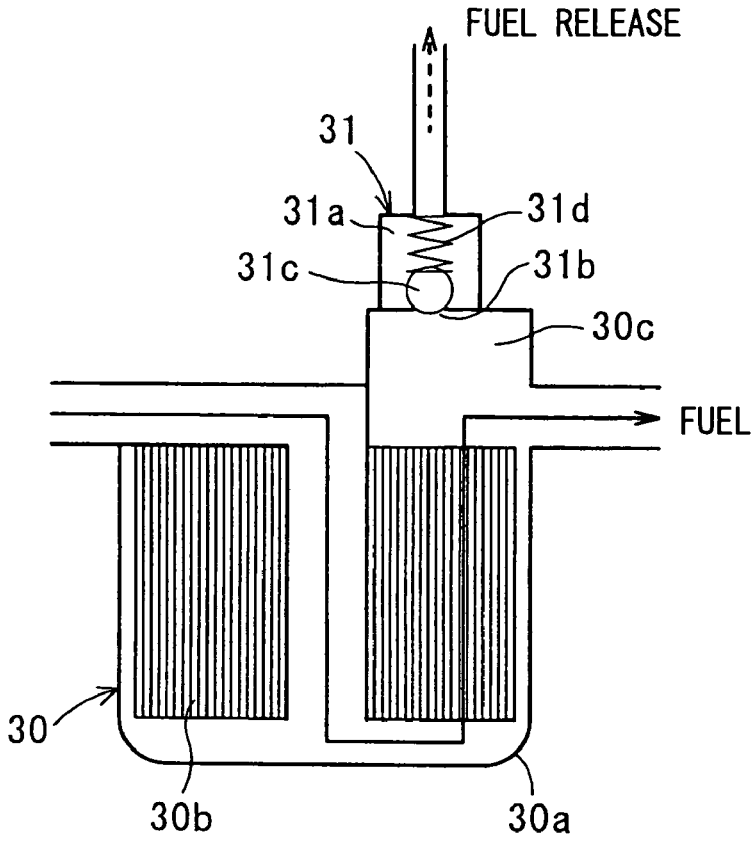
FIG. 5 is a sectional diagram showing a fuel filter and a relief valve according to a fifth embodiment of the present invention.

Referring to FIG. 5, a fuel filter 30 and a relief valve 31 according to a fifth embodiment of the present invention is illustrated. The relief valve 31 of this embodiment has a function of bleeding the air from the fuel pipe system in the fuel injection system of the first or third embodiment, which does not include the air-bleeding valve 38 used in the system of the second or fourth embodiment.

As shown in FIG. 5, an air collection chamber 30*c* is formed in a space in a filter case 30*a* of the fuel filter 30 where the air will easily collect. For example, the air collection chamber 30*c* is formed above a filter element 30*b* contained in the filter case 30*a*.

The relief valve 31 has a valve chamber 31*a*, a ball valve 31*c*, a spring 31*d* and the like. The valve chamber 31*a* is formed above the air collection chamber 30*c*. The ball valve 31*c* is located in the valve chamber 31*a* to open or close a communication hole 31*b* that connects the valve chamber 31*a* with the air collection chamber 30*c*. The spring 31*d* biases the ball valve 31*c* in a valve-closing direction (direction for closing the communication hole 31*b*).

Thus, if the fuel pressure acting on the fuel filter 30 (the fuel pressure acting on the ball valve 31*c*) exceeds the biasing force of the spring 31*d*, the ball valve 31*c* opens the communication hole 31*b*. Accordingly, the fuel pressure acting on the fuel filter 30 is released through the relief valve 31, and the air collecting in the air collection chamber 30*c* is bled.

Figure 6:
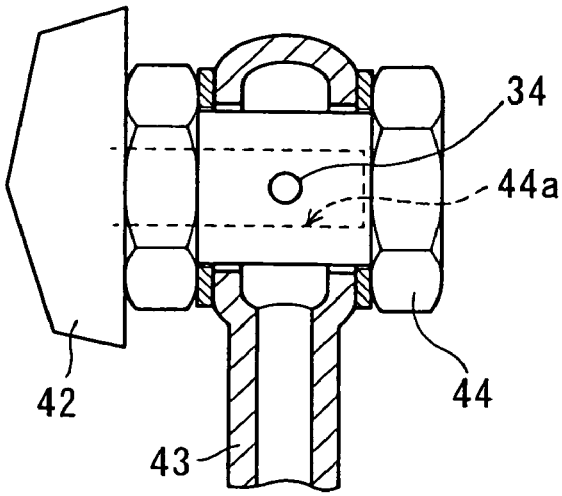
FIG. 6 is a partly-sectional view showing a flow rate restricting device according to a sixth embodiment of the present invention.
Figure 7:
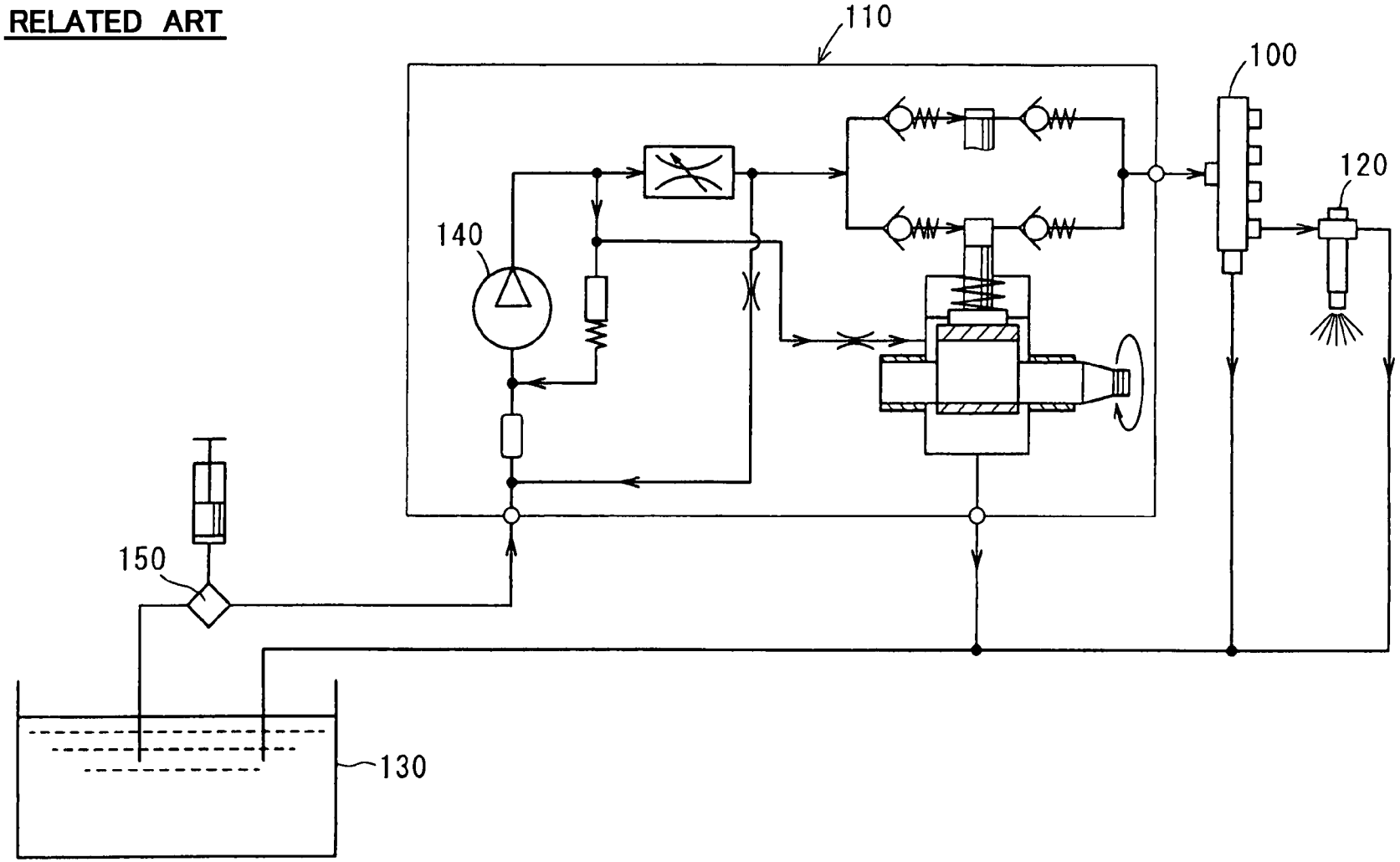
FIG. 7 RELATED ART
FIG. 7 is a diagram showing a pressure accumulation fuel injection system of a related art.
Figure 8:
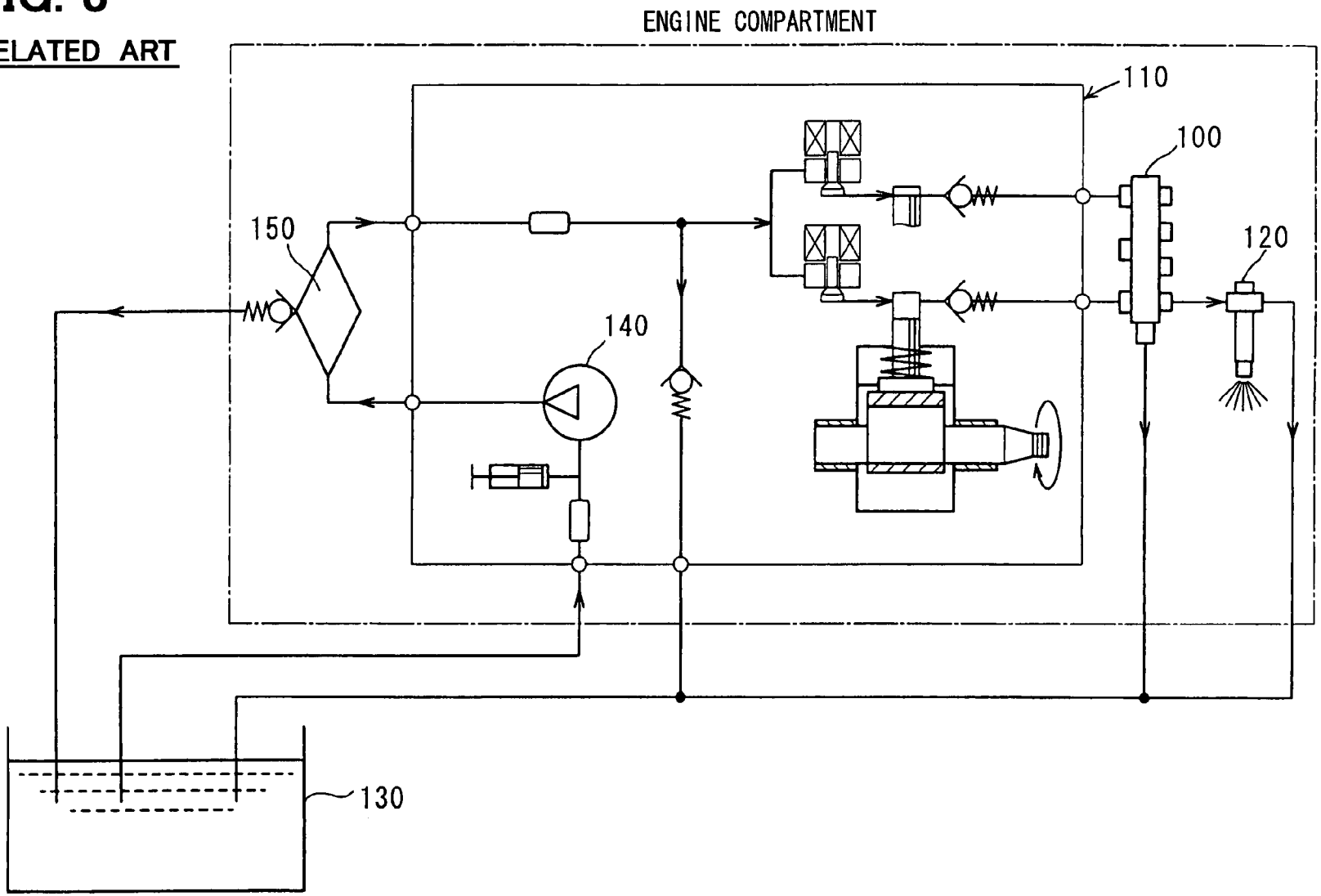
FIG. 8 RELATED ART
FIG. 8 is a diagram showing a pressure accumulation fuel injection system of another related art.

Referring to FIG. 6, a mounting structure of a flow rate restricting device according to a sixth embodiment of the present invention is illustrated.

The flow rate restricting device according to the sixth embodiment provides an orifice 34 (flow rate restricting device) as a separate body that can be attached to and detached from a pump housing 42 of the pressure accumulation fuel injection system of any one of the first to third embodiments. As shown in FIG. 6, an end of a fuel pipe 43 connected to the downstream side of the fuel filter 30 (shown in FIGS. 1 to 3) can be attached to and detached from the pump housing 42 through a hollow screw 44.

The hollow screw 44 is formed with a hollow 44*a* inside thereof, and is formed with an orifice 34 communicating with the hollow 44*a* through a side wall of the hollow screw 44. The fuel pipe 43 communicates with the hollow 44*a* through the orifice 34. The hollow 44*a* of the hollow screw 44 provides a passage downstream of the orifice 34. The hollow 44*a* communicates with a fuel passage (not shown) formed in the pump housing 42 in a state in which the hollow screw 44 is attached to the pump housing 42. An orifice diameter can be changed by changing the hollow screw 44. As a result, a common main body of the fuel supply device can be used.

The present invention should not be limited to the disclosed embodiments, but may be implemented in many other ways without departing from the spirit of the invention.

What is claimed is:

1. A fuel supply device for pressure accumulation fuel injection system including a common rail that accumulates high-pressure fuel and an injector that injects the high-pressure fuel supplied by the common rail into a cylinder of an internal combustion engine, the fuel supply device supplying the high-pressure fuel to the common rail, and comprising:

a high-pressure pump that pressurizes fuel and pressure-feeds fuel to the common rail;

a feed pump driven by the engine to draw fuel from a fuel tank and to supply fuel to the high-pressure pump;

a suction quantity control valve located downstream of the feed pump to control a quantity of fuel supplied from the feed pump to the high-pressure pump;

a fuel filter located between the feed pump and the suction quantity control valve to filter fuel discharged by the feed pump;

a flow rate restricting device located upstream of the suction quantity control valve to restrict a flow rate of fuel passing through the fuel filter; and a relief valve located between the feed pump and the fuel filter, wherein the relief valve opens to release fuel pressure acting on the fuel filter if fuel pressure acting on the fuel filter exceeds a predetermined value.

2. The fuel supply device for a pressure accumulation fuel injection system including a common rail that accumulates high-pressure fuel and an injector that injects the high-pressure fuel supplied by the common rail into a cylinder of an internal combustion engine, the fuel supply device supplying the high-pressure fuel to the common rail and comprising:

a high-pressure pump that pressurizes fuel and pressure-feeds fuel to the common rail;

a feed pump driven by the engine to draw fuel from a fuel tank and to supply fuel to the high-pressure pump;

a suction quantity control valve located downstream of the feed pump to control a quantity of fuel supplied from the feed pump to the high-pressure pump;

a fuel filter located between the feed pump and the suction quantity control valve to filter the fuel discharged by the feed pump; and a flow rate restricting device located upstream of the suction quantity control valve to restrict a flow rate of the fuel passing through the fuel filter;

wherein the flow rate restricting device is located between the feed pump and the suction quantity control valve.

3. The fuel supply device as in claim 1, wherein the flow rate restricting device is located upstream of the feed pump.

4. The fuel supply device as in claim 1, wherein the relief valve opens at a valve opening pressure lower than a discharge pressure of the feed pump generated during idling operation of the engine.

5. The fuel supply device as in claim 1, wherein the relief valve opens in a rotation speed area higher than idling rotation speed of the engine.

6. The fuel supply device as in claim 1, wherein the relief valve is located upward from the fuel filter.

7. The fuel supply device as in claim 1, further comprising:

a regulation valve located between the flow rate restricting device and the suction quantity control valve to regulate a discharge pressure of the feed pump.

8. The fuel supply device as in claim 1, wherein the flow rate restricting device is an orifice.

9. The fuel supply device as in claim 8, wherein the orifice is formed in a separate body that can be attached to and detached from a main body of the high-pressure pump.

10. The fuel supply device as in claim 1, wherein the flow rate restricting device is an electromagnetic valve.

11. The fuel supply device as in claim 1, wherein the relief valve releases fuel directly to the fuel tank if fuel pressure acting on the fuel filter exceeds the predetermined value.

* * * * *